US006430963B1

(12) United States Patent
Friedman et al.

(10) Patent No.: US 6,430,963 B1
(45) Date of Patent: Aug. 13, 2002

(54) DIAMOND CUT

(75) Inventors: Isaac Friedman; Philip Katz, both of New York, NY (US)

(73) Assignee: Simka Diamonds Corporation, New York, NY (US)

( * ) Notice: Subject to any disclaimer, the term of this patent is extended or adjusted under 35 U.S.C. 154(b) by 0 days.

(21) Appl. No.: 09/649,920

(22) Filed: Aug. 30, 2000

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

| | | | | | |
|---|---|---|---|---|---|
| D36,167 | S | * | 12/1902 | Schenck | 63/32 |
| 2,143,084 | A | * | 1/1939 | Nirenstein | 63/32 |
| D124,598 | S | * | 1/1941 | Brodovitch | D9/307 |
| 2,364,031 | A | | 11/1944 | Suderov | |
| D141,258 | S | | 5/1945 | Fine | |
| D141,259 | S | | 5/1945 | Fine | |
| D143,470 | S | | 1/1946 | Fine | |
| 3,763,665 | A | | 10/1973 | Polakiewicz | |
| 4,020,649 | A | | 5/1977 | Grossbard | |
| 4,306,427 | A | | 12/1981 | Urban | |
| D277,942 | S | * | 3/1985 | Valckx | 63/32 |
| 5,072,549 | A | * | 12/1991 | Johnston | 451/41 |
| D330,344 | S | * | 10/1992 | Hedgecock | D11/90 |
| 5,186,024 | A | * | 2/1993 | Waters, Jr. | 63/32 |
| 5,664,440 | A | * | 9/1997 | Roemer | 63/15 |
| 5,970,744 | A | | 10/1999 | Greeff | |
| D439,196 | S | * | 3/2001 | Tolkowsky | D11/90 |
| D439,542 | S | * | 3/2001 | Turner et al. | D11/90 |
| D442,114 | S | * | 5/2001 | Greeff | D11/90 |

OTHER PUBLICATIONS

"Nouvelles Tailles Pour Le Diamant", La France Horlogere, France No. 497, Nov. 1988, p. 155.*

* cited by examiner

*Primary Examiner*—Jack Lavinder
*Assistant Examiner*—Andrea Chop
(74) *Attorney, Agent, or Firm*—Stephen E. Feldman, PC

(57) ABSTRACT

A brilliant gemstone cut, having a crown, a girdle and a pavilion. The crown and the pavilion are both brilliant cut. The crown has a flat table shaped as an equilateral n-sided polygon, n corner facets and n upper girdle facets. The girdle is also shaped as an n-sided polygon. The pavilion has n rib lines, which converge at a culet, n lower girdle facets, n bezel star facets and double n number of corner facets. The rib lines subdivide the pavilion into n equivalent parts.

23 Claims, 3 Drawing Sheets

DIAMOND CUT

FIELD OF THE INVENTION

The present invention relates to the field of diamond cuts. Specifically, the present invention is directed toward diamond cut having a brilliant cut pavilion and a brilliant cut crown. The crown has a flat octagonal table, eight upper girdle facets and eight corner facets. The pavilion has a culet, eight rib lines and multiple lower girdle facets, corner facets and bezel facets.

BACKGROUND OF THE INVENTION

There are a variety of step and brilliant gemstone cuts available on the market that achieve good coefficients of brilliancy, dispersion and scintillation. However, due to several problems that the prior art presents there is a long felt but unfulfilled need for a better gemstone cut. The present invention fulfills that long felt need by providing a brilliant cut that achieves excellent coefficients of brilliancy, dispersion and scintillation, along with achieving best elegant and classic looks.

There are several U.S. Patents available, however, all of them present certain problems and do not fulfill the need for a better diamond cut.

U.S. Patent No. 2,364,031 to Suderov presents brilliant type cut diamond and a method of cutting it. The diamond cut in this prior art has a table that is in the form of a twelve-sided polygon. Moreover, the number of facets, either corner or girdle, is at least twelve, whereas, the present invention consists of a brilliant type diamond cut, having eight facets, be it corner or girdle facets. Furthermore, the table is in the form of an octagon, where the prior art has a table with at least twelve corners.

U.S. Pat. No. 3,763,665 to Polakiewiz presents a brilliant cut diamond. This prior art has an octagonal table, eight small facets in a shape of a trapezoid with a large base, eight triangular facets having as its base the large base of the above small facets, eight quadrangular facets, eight pairs of generally trapezoidal facets and several other pairs of either triangular or trapezoidal facets in pairs of eight. The present invention, also, having an octagonal table, has only eight triangular corner facets and eight triangular upper girdle facets, which is significantly different from this particular prior art.

U.S. Pat. No. 4,020,649 to Grossbard presents a brilliantized step cut diamond, where the cut has a step cut crown having multiple facets and a brilliant cut pavilion. The present invention comprises of itself a brilliant cut crown and a brilliant cut pavilion.

U.S. Pat. No. 4,306,427 to Urban teaches a brilliant single crystal alexandrite gemstone having an axis of symmetry, a crown, a girdle and a pavilion. The table is a regular polygon having between 7 and 13 sides. The gemstone has an equivalent number of congruent triangular star facets, wherein each facet has at least two substantially equal sides; an equivalent number of congruent triangular upper girdle facets, wherein each triangular fact has a common vertex with a star facet; an equivalent number of congruent kit-shaped main facets, wherein each facet has a side coinciding with each of the four surrounding facets. Moreover, the gemstone has a girdle having equivalent number of rectangular being parallel to the axis of symmetry. Finally, the gemstone has a pavilion comprising of lower girdle triangular facets with sides coinciding with girdle rectangular facets' sides; congruent kite-shaped culet facets with vertices coinciding with lower girdle facets; and, congruent pavilion main facets. The present invention has an octagon-shaped table with only triangular facets with bases and vertices attached either to the table or the girdle's plane. The pavilion comprises of the eight rib lines, which the prior art is missing, sixteen triangular corner facets, a bezel star, and five-sided congruent polygonal lower girdle facets. This makes the present invention substantially different from this particular prior art.

U.S. Pat. No. 5,970,744 to Greeff discloses a cut cornered mixed cut gemstone, which has a step cut crown and a brilliant cut pavilion. The crown has two steps, a table, and a girdle. The crown and the pavilion are substantially square with four equal sides and corners about ⅓ the length of the sides. The present invention has a octagon-shaped girdle and table. Moreover, the crown is a brilliant cut, unlike the prior art, contains eight congruent corner facets and eight congruent upper girdle facets. The pavilion contains several rib lines, eight lower girdle facets and bezel star facets.

U.S. Pat. Nos. Des. 141,258, 141,259 and 143,470 to Fine teaches a brilliant cut gemstone having a multitude of facets in its crown with several corner facets and upper girdle facets. The upper girdle facets have other facets imbedded into them. The pavilion does not have any rib lines but has a bezel star and semi-triangular lower girdle facets. The girdle has a form of a circle. The present invention significantly differs from this prior art by having an octagon shaped girdle and crown. Moreover, the pavilion contains rib lines dividing it into several facet sections.

While the prior art of a diamond cut is of a significant interest, it does not address a specific need of a particular way of having a gemstone cut, that achieves best brilliancy, scintillation and dispersion coefficients. The present invention addresses a brilliant gemstone cut that achieves excellent coefficients for many characteristics of a gemstone.

SUMMARY OF THE INVENTION

The present invention is directed towards a gemstone cut.

The main object of the present invention is to provide a brilliant cut gemstone, with a brilliant cut crown, girdle and a brilliant cut pavilion.

It is another object of the present invention to provide a brilliant cut gemstone that provides good dispersion, brilliancy and scintillation.

It is another object of the present invention to provide a brilliant cut gemstone having a brilliant cut crown that has an octagon-shaped flat table and a octagon-shaped girdle.

It is another object of the present invention to provide a brilliant cut gemstone having a brilliant cut crown that has eight congruent triangular corner facets with a base being one of the side of the octagon circumscribing the table and a vertex being on the girdle.

It is another object of the present invention to provide a brilliant cut gemstone having a brilliant cut crown having eight congruent triangular upper girdle facets with their bases on the girdle plane and vertices being corners of the octahedron comprising the table.

It is another object of the present invention to provide a brilliant cut gemstone having a brilliant cut pavilion having eight rib lines subdividing the pavilion into eight sections, where each section contains congruent bezel star facets, congruent lower girdle facets having a polygonal shape and sixteen congruent corner facets.

It is another object of the present invention to provide a brilliant cut gemstone having a brilliant cut pavilion having a culet, where the rib lines converge.

Other objects of the present invention might become apparent from the foregoing description.

BRIEF DESCRIPTION OF THE DRAWINGS

The following description of preferred embodiment of the present invention will be better understood when read in conjunction with the appended drawings. It should be understood, however, that the invention is not limited to the precise arrangements shown in which.

DETAILED DESCRIPTION OF THE PREFERRED EMBODIMENT

The present invention relates to a new gemstone cut. The present invention would be better understood in conjunction with a following description of a preferred embodiment. However, it is understood by one skilled in the art that the present invention is not limited to the above referenced specific embodiment, but other embodiments are allowable, provided they are within the scope and spirit of the following claims.

In the following description, references to the drawings, certain terms are used for conciseness, clarity and comprehension. It is assumed by one skilled in the art that there are to be no unnecessary limitations implied from the such references, besides the limitations imposed by the prior art, because such terms and references are used for descriptive purposes only and intended to be broadly construed. Furthermore, the description and the drawings are for illustrative purposes only and not to be construed as limited to the exact details shown, depicted, represented, or described.

For illustrative purposes only, the present invention's preferred mode is a brilliant gemstone cut, having a brilliant cut crown consisting of a flat table, corner facets and upper girdle facets, a girdle, a brilliant cut pavilion having rib lines, bezel star facets and lower girdle facets.

Figure 1:
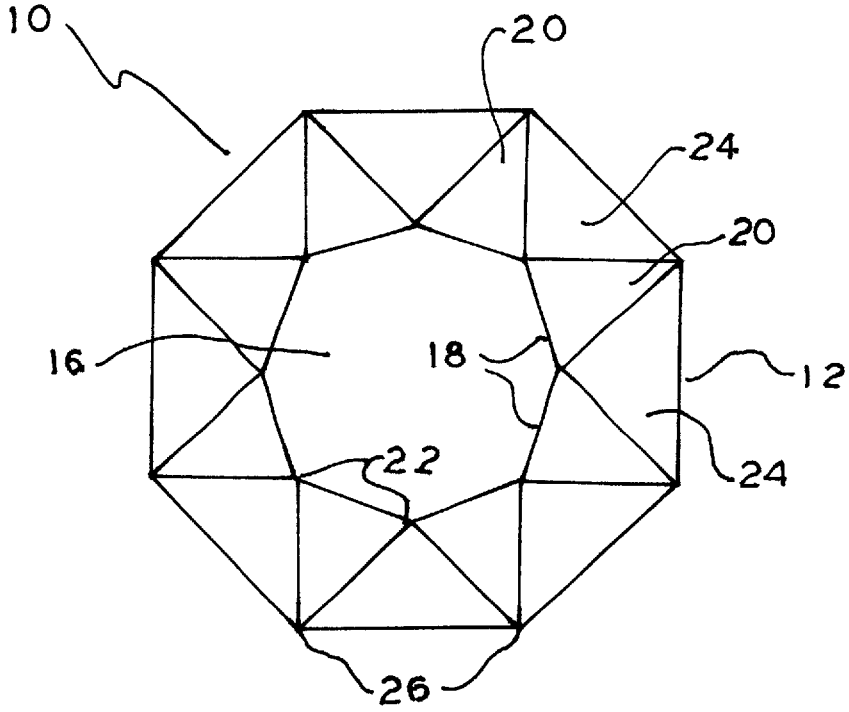
FIG. 1 is perspective view of the top of the gemstone cut showing a crown with a flat table and crown faces.
Figure 2:
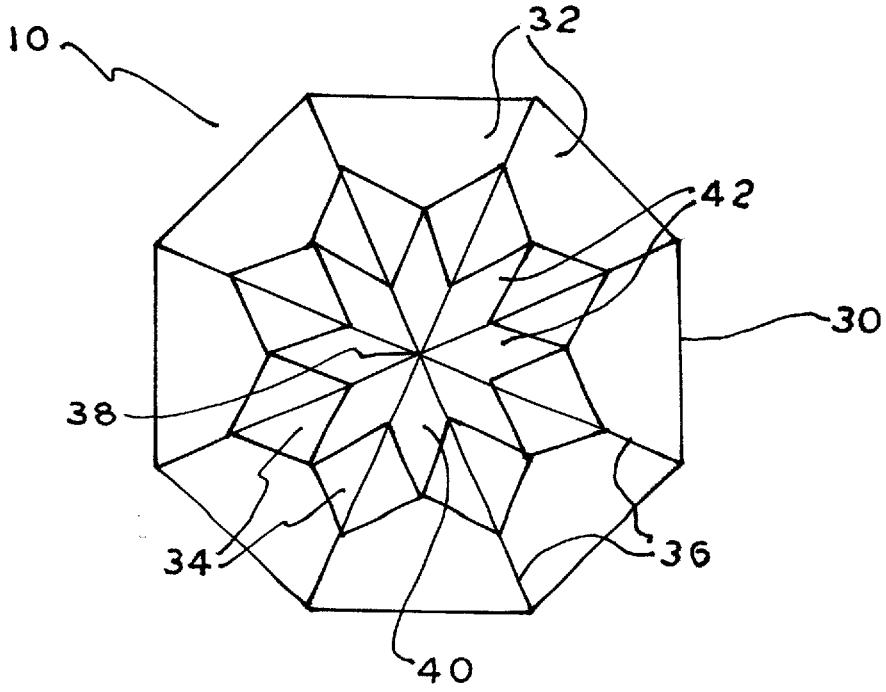
FIG. 2 is perspective view of the bottom of the gemstone cut showing a pavilion with a point culet, bezel star and its facets, and lower girdle facets.

Referring to FIG. 1, a gemstone 10 is shown from the top. The gemstone 10 has a crown 12. The crown 12 is a brilliant cut crown, having a flat table 16, several upper girdle facets 24 and corner facets 20. The table is shaped as an n-sided polygon. In this particular embodiment, the table 16 is shaped as an octagon. Referring to FIGS. 1 and 2, the table 16 and a girdle 50 are shaped equivalently, i.e., the table and a girdle are both n-sided polygons (e.g., in the pictured embodiment, both of them are octagons).

Referring to FIG. 1, the table 16 is shown elevated 55° to 60° off the surface of the girdle plane. The table 16 is in the form of a right octagon having vertices 22. The vertices 22 serve as vertices for upper girdle facets 24, which can be either equilateral or isosceles triangles having their bases on the girdle's plane. The crown 12 also has corner facets 20, which can also be either equilateral or isosceles triangles. The corner facets 20 have vertices 26, which lie in the girdle's plane. The bases 18 of corner facets 20 are the sides of octagon that encompasses the table 16.

In one embodiment, the degree of inclination with respect to girdle's plane of corner facets 20 may range from 35.7° to 41.9°. Moreover, the inclination, with respect to the girdle's plane, of the upper girdle facets 24 may range from 30° to 36°. The present invention is not limited to these particular angular inclinations and it may be obvious to one skilled in the art that other angular inclinations are possible.

Referring to FIG. 2, the gemstone cut 10 is pictured showing its pavilion 30. The pavilion 30 has a culet 38, which in this particular embodiment is a point culet. The pavilion comprises rib lines 36, which subdivide the pavilion into equal pavilion facets. The rib lines 36 run from the girdle plane and converge at the culet 38. The number of the rib lines depends on the number of vertices that the girdle has. In this particular embodiment, there are eight rib lines in accordance with eight vertices of the girdle plane. The pavilion 30 has a bezel star 40, which the rib lines 36 subdivide into equivalent bezel facets 42. In this embodiment, there are eight equivalent facets 42. Each facet 42 is shaped as a diamond with one of its vertices being the culet 38 of the pavilion 30 and the opposite vertex being the vertex of the lower girdle facet 32. The two sides adjacent to the vertex, located at culet 38, are along the rib lines 36. The two sides adjacent to the vertex, located at the vertex of the of the lower girdle facet 32, are the sides of the corner facets 34. In this embodiment, all of the sides of the bezel star facet 42 are equivalent.

The rib lines 36 create an equal number of equivalent lower girdle facets 32. The lower girdle facets 32 are five-sided polygons with its longer sides located on the girdle's plane and two of its sides along the rib lines 36. The inclination of the facets 32 with respect to the girdle's plane in this particular embodiment may range from 53.8° to 59.8°, however, other inclinations may be possible. The pavilion also contains an even number of corner facets 34 created by the rib lines 36 and the bezel star facets 42. The corner facets 34 are triangles with their bases adjoining, and, are located along the rib lines 36. One side of each triangle of the corner facet 34 is along the lower girdle facet 32 and the other side is along the bezel star facet 42. The number of the corner facets 32 is proportional to the number of vertices that the girdle has. The number of the corner facets is twice the number of the vertices. In this particular embodiment, since the number of the vertices is eight, the number of the facets is 16. Referring to FIG. 2, in this particular embodiment, the inclination of the bezel star facets 42 with respect to the girdle's plane may range from 38.1° to 43.9°. Moreover, in the same embodiment, the inclination of the corner facets 34 with the respect to the girdle's plane may range from 40.1° to 46.9°. Finally, the inclination of the lower girdle facets 32 with the respect to the girdle's plane may range from 53.8° to 59.8°.

Figure 3:
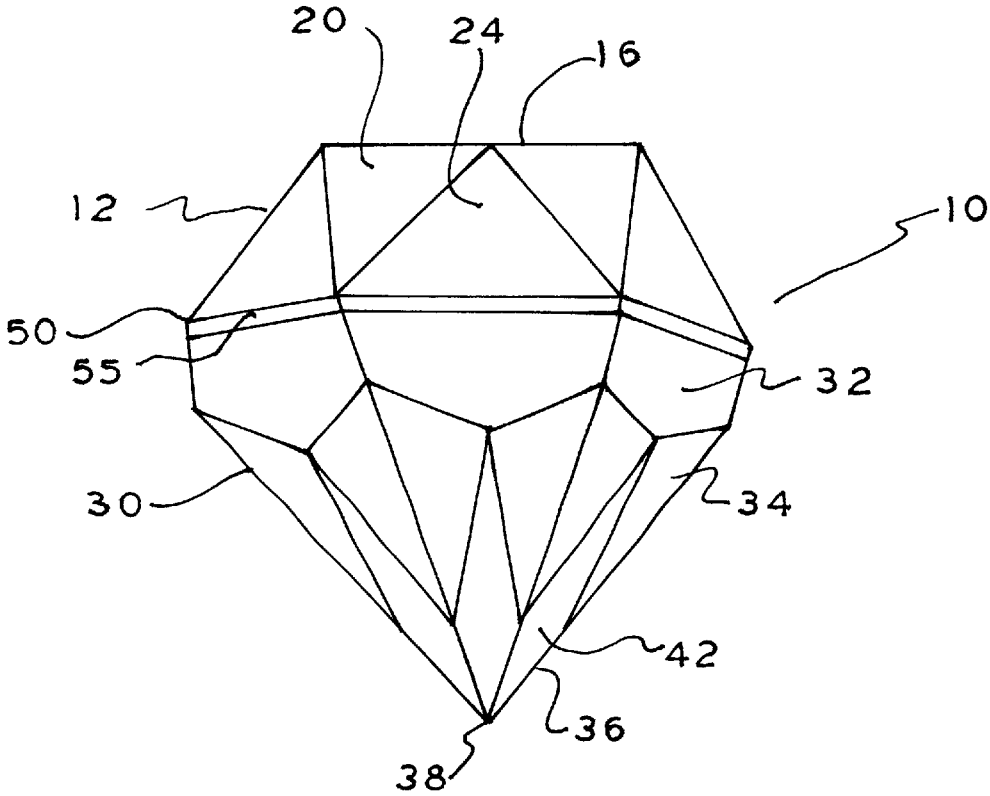
FIG. 3 is a side view of the gemstone cut showing a crown, a girdle and a pavilion with all of their respective facets.

Referring to FIG. 3, the gemstone cut 10 is depicted from its side showing the crown 12 with all of its facets, the girdle 50, and the pavilion 30 with all of its facets. The girdle 50 has a shape of an n-sided polygon in adherence with the number of the vertices that the table has. Here, the girdle 50 is an equilateral octagon. The girdle 50 has small rectangular facets 55. The length side of the facets 55 is either the base of the upper girdle facet 24 or the lower girdle facet 32. The width side of the girdle facet is a continuation of the rib lines 36. In one embodiment, the girdle's width may range from 1.5% to 4.9% of the total height of the gemstone cut 10.

Figure 4:
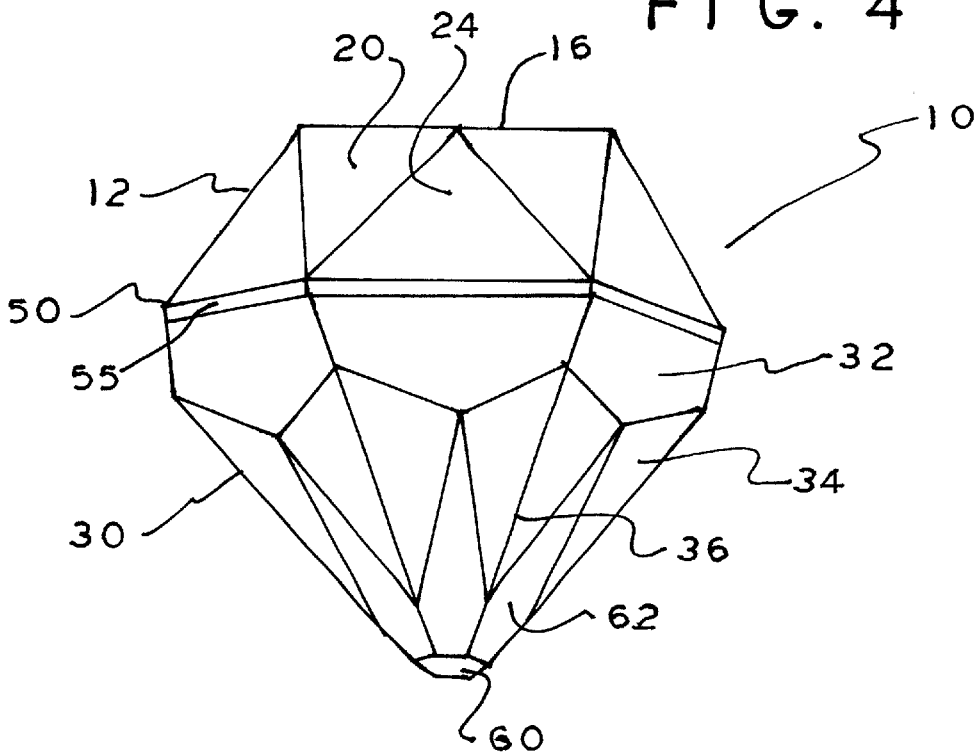
FIG. 4 is a side view of the gemstone cut showing a crown, a girdle and a pavilion with a flat culet facet.
Figure 5:
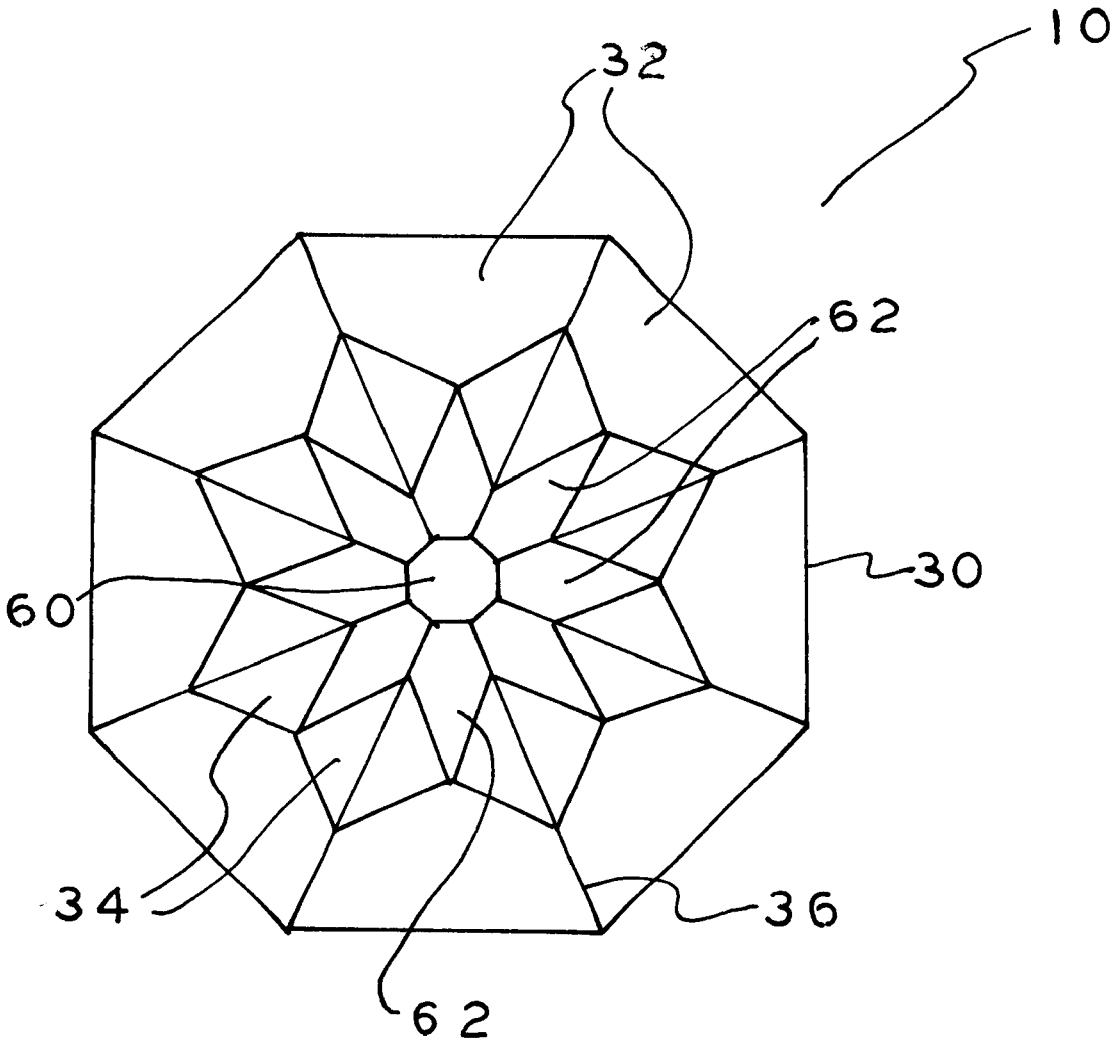
FIG. 5 is a perspective view of the gemstone cut in FIG. 4, shown from the bottom.

In yet other embodiments, referring to FIGS. 4 and 5, a culet may be chosen in a form of a polygon. FIGS. 4 and 5 depict the gemstone cut 10 with octagonal culet 60. As in the embodiments described above, the rib lines 36 run from the girdle 55 and subdivide the gemstone 10 pavilion 30 into equal parts. However, in this embodiment, the rib lines do not converge at a point, but stop at a culet facet 60. Each rib line 36 ends in one of the vertices of the octagonal culet facet 60. Moreover, the bezel star facets 62 are no longer in a shape of a diamond. Now, the facets 62 assume a shape of a candle-like polygon, where a top portion of such polygon appears to be an isosceles triangle and a bottom portion of such polygon appears to be a equilateral trapezoid.

The present invention may utilize any precious or semi-precious stones such as diamonds, rubies or any other conventionally known precious or semi-precious stones.

In the foregoing description of the invention, reference to the drawings, certain terms, have been used for clarity, conciseness and comprehension. However, no unnecessary limitations are to be implied from or because of the terms used, beyond the requirements of the prior art, because such terms are used for descriptive purposes and are intended to e broadly construed. Furthermore, the description and illustration of the invention are by way of example, and the scope of the invention is not limited to the exact details shown, represented, or described.

While the present invention has been described with reference to specific embodiments, it is understood that the invention is not limited but rather includes any and all changes and modifications thereto which would be apparent to those skilled in the art and which come within the spirit and scope of the appended claims.

What is claimed:

1. A gemstone cut, wherein said gemstone cut is a brilliant cut gemstone, comprising a) a brilliant cut crown located on an upper side of a girdle, said girdle having a plane and comprising n sides, wherein n is an integer; and b) a pavilion located on a lower side of said girdle comprising:

a culet;

rib lines, wherein the number of said rib lines is said n;

said rib lines subdivide said pavilion into said n parts;

said rib lines run from said girdle and converge at said culet;

lower girdle facets, wherein the number of said lower girdle facets is said n;

said lower girdle facets are shaped as m-sided polygons, with one side of each of said m-sided polygons forming one side of said girdle and where m is an integer number more than three and less than said n;

lower corner facets of said pavilion, wherein the number of said lower corner facets of said pavilion is equal to twice said n;

said lower corner facets of said pavilion are shaped as triangles, where said triangles have their bases along said rib lines on opposite sides of each of said rib lines;

said lower corner facets being spaced from both of said culet and said girdle; and each of said lower corner facets touching two others of said lower corner facets.

2. The gemstone cut of claim 1, wherein said brilliant cut crown comprises:

a table shaped as an equilateral polygon having said n sides, said table having said n vertices;

upper corner facets, wherein the number of said upper corner facets is equal to said n and said upper corner facets have a triangular shape; and upper girdle facets, wherein the number of said upper girdle facets is equal to said n and said upper girdle facets have a triangular shape.

3. The gemstone cut of claim 2, wherein said n is equal to 8.

4. The gemstone cut of claim 2, wherein said table is shaped as an equilateral octagon.

5. The gemstone cut of claim 2, wherein said upper corner facets are shaped as either isosceles or equilateral triangles.

6. The gemstone cut of claim 5, wherein said upper corner facets have an inclination of 35.7 to 41.9 degrees of arc with respect to the plane of said girdle.

7. The gemstone cut of claim 2, wherein said upper girdle facets are shaped as either isosceles or equilateral triangles.

8. The gemstone cut of claim 7, wherein said upper girdle facets have an inclination of 30 to 36 degrees of arc with respect to the plane of said girdle.

9. The gemstone cut of claim 1, wherein said girdle is shaped as an equilateral octagon.

10. The gemstone cut of claim 9, wherein a width of said girdle is 1.5% to 4.9% of a total height of said gemstone cut.

11. The gemstone cut of claim 1, wherein said gemstone is one of a precious or semi-precious stone.

12. The gemstone cut of claim 1, wherein said culet is a point.

13. The gemstone cut of claim 1, wherein said culet is a polygonal facet.

14. The gemstone cut of claim 1, wherein said number of said rib lines is eight.

15. The gemstone cut of claim 1, wherein said pavilion has a bezel star and said bezel star has said n bezel star facets.

16. The gemstone of claim 15, wherein said bezel star facets have a diamond shape.

17. The gemstone of claim 15, wherein said bezel star facets have a polygonal shape.

18. The gemstone cut of claim 1, wherein said lower corner facets have an inclination of 40.1 to 46.9 degrees of arc with respect to the plane of said girdle.

19. The gemstone cut of claim 1, wherein said lower girdle facets are shaped as five sided polygons with two sides of said lower girdle facets being along said rib lines and a base of said lower girdle facet being along the plane of said girdle.

20. The gemstone cut of claim 19, wherein said lower girdle facets have an inclination of 53.8 to 59.8 degrees of arc with respect to the plane of said girdle.

21. A gemstone cut, wherein said gemstone cut is a brilliant cut gemstone, comprising:

a) a crown, wherein said crown is located on an upper side of a girdle and comprises:

a table shaped as an equilateral n-sided polygon, wherein n is a number of vertices in said table;

upper corner facets, wherein the number of said upper corner facets is equal to said n and said upper corner facets have a triangular shape;

upper girdle facets, wherein the number of said upper girdle facets is equal to said n and said upper girdle facets have a triangular shape; and b) a pavilion, wherein said pavilion is located on a lower side of said girdle and comprises:

a culet;

rib lines, wherein the number of said rib lines is said n;

said rib lines subdivide said pavilion into said n parts;

said rib lines run from said girdle and converge at said culet;

lower girdle facets, wherein the number of said lower girdle facets is said n;

said lower girdle facets are shaped as m-sided polygons, with one side of each of said m-sided polygons being along said girdle and where m is an integer number more than three and less than said n;

lower corner facets of said pavilion, wherein the number of said lower corner facets of said pavilion is equal to twice said n; and said lower corner facets of said pavilion are shaped as triangles, where said triangles have their bases along said rib lines; and each of said lower corner facets touching two others of said lower corner facets.

22. A gemstone cut, wherein said gemstone cut is a brilliant cut gemstone, comprising a) a brilliant cut crown located on an upper side of a girdle, said girdle comprising n sides, where n is an interger; and b) a pavilion comprising:

a culet;

rib lines, wherein the number of said rib lines is said n;

said rib lines subdivide said pavilion into said n parts;

said rib lines run from said girdle and converge at said culet;

lower girdle facets, wherein the number of said lower girdle facets is said n;

said lower girdle facets are shaped as m-sided polygons, with one side of each of said m-sided polygons forming one side of said girdle and where m is an integer number more than three and less than said n;

lower corner facets of said pavilion, wherein the number of said lower corner facets of said pavilion is equal to twice said n;

said lower corner facets of said pavilion are shaped as triangles, where said triangles have their bases along said rib lines on opposite sides of each of said rib lines; and each of said lower corner facets touching two others of said lower corner facets; and a bezel star having said n bezel star facets, said bezel star facets having two adjacent sides along adjacent rib lines and two other adjacent sides meeting at a corner on one lower girdle facet, and forming sides with a lower corner facet of said pavilion.

23. The gemstone cut of claim 22, wherein said bezel star facets have an inclination of 38.1 to 43.9 degrees of arc with respect to the plane of said girdle.

* * * * *